US009176421B2

(12) United States Patent
Fujii

(10) Patent No.: US 9,176,421 B2
(45) Date of Patent: Nov. 3, 2015

(54) CARTRIDGE INCLUDING A COVER HAVING RELEASABLE ENGAGEMENT

(71) Applicant: Yasumasa Fujii, Anjo (JP)

(72) Inventor: Yasumasa Fujii, Anjo (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 85 days.

(21) Appl. No.: 14/040,061

(22) Filed: Sep. 27, 2013

(65) Prior Publication Data

US 2014/0161487 A1 Jun. 12, 2014

(30) Foreign Application Priority Data

Dec. 10, 2012 (JP) ..... 2012-269298

(51) Int. Cl.
*G03G 21/18* (2006.01)
*G03G 15/08* (2006.01)

(52) U.S. Cl.
CPC ..... *G03G 15/0875* (2013.01)

(58) Field of Classification Search
CPC ..... E05B 63/0056; E05B 65/00; E05B 7/00; E05B 85/10; B60R 11/00; B65D 11/1893; B65D 39/0076; B65D 43/02; B65D 50/046; G03G 21/1676; G03G 21/169; G03G 15/0896
USPC ..... 399/114, 119
See application file for complete search history.

(56) References Cited

U.S. PATENT DOCUMENTS

2004/0114961 A1* 6/2004 Yoshino et al. ..... 399/119
2011/0233093 A1 9/2011 Fujii
2013/0077994 A1* 3/2013 Takiguchi ..... 399/123

FOREIGN PATENT DOCUMENTS

JP 2003-195730 A 7/2003
JP 2011-203364 A 10/2011
JP 2014-016495 A * 1/2014

* cited by examiner

*Primary Examiner* — Walter L Lindsay, Jr.
*Assistant Examiner* — Ruth Labombard
(74) *Attorney, Agent, or Firm* — Merchant & Gould PC

(57) ABSTRACT

A cartridge includes: a rotating body including a rotating shaft extending in a first direction and carrying developer; a housing supporting the rotating body; and a cover removably mounted on the housing and protect the rotating body. The cover includes: a grasping portion that is provided substantially at a center of the cover in the first direction; and a first engaging claw that is disposed on an outer side of the cover with respect to the grasping portion in the first direction, and is configured to engage the cover with the housing. The housing includes an engaged portion engaged with the first engaging claw. If the grasping portion is operated to remove the cover from the housing, the first engaging claw moves toward the center of the cover in the first direction and engagement of the first engaging claw and the engaged portion is released.

6 Claims, 17 Drawing Sheets

CARTRIDGE INCLUDING A COVER HAVING RELEASABLE ENGAGEMENT

CROSS REFERENCE TO RELATED APPLICATION

This application is based upon and claims the benefit of priority of Japanese Patent Application No. 2012-269298 filed on Dec. 10, 2012, the contents of which are incorporated herein by reference in its entirety.

BACKGROUND

The present disclosure relates to a cartridge for an image forming apparatus such as a laser printer.

As image forming apparatuses, printers having cartridges detachably mounted on main body casings are known.

As a cartridge for these printers, there is known a developing cartridge having a housing for storing toner, and a developing roller for carrying toner on its circumferential surface.

In this developing cartridge, the developing roller is rotatably held on both side walls of the housing, and a portion of the circumferential surface of the developing roller is exposed from the housing to the outside. Therefore, during shipment or transportation of the developing cartridge, in order to cover the exposed developing roller, a developing roller cover is mounted on the housing the developing cartridge.

Further, this developing roller cover has locking claws protruding toward the developing roller side, and the locking claws are locked to locked portions of the housing of the developing cartridge, whereby the developing roller cover is mounted on the developing cartridge. The developing roller cover can be removed from the housing by pulling a grasping portion.

SUMMARY

Recently, image forming apparatuses have been miniaturized, and developer carriers for image forming apparatuses also have been miniaturized.

However, in the related developing roller cover, the locking claws are provided almost at the center of the developing roller in an axial direction. Therefore, in a case of miniaturizing the developing cartridge, the developing roller and the developing roller cover becomes close to each other. For this reason, the developing roller may become likely to be damaged by the locking claws.

Therefore, it is desired to provide the locking claws both outer sides of the developing roller in the axial direction and to provide the grasping portion almost at the center in the axial direction.

However, according to this configuration, a force from the grasping portion is not transmitted to the locking claws, and thus it becomes difficult to remove the developing roller cover from the developing cartridge.

Therefore, an object of an aspect of the present disclosure is to provide a small-sized cartridge in which it is possible to securely protecting a rotating body by a cover while attaining miniaturization and it is possible to easily remove the cover from a housing.

A cartridge comprising:

a rotating body including a rotating shaft extending in a first direction and configured to carry developer;

a housing configured to support the rotating body; and a cover that is configured to be removably mounted on the housing and protect the rotating body, wherein the cover includes:

a grasping portion that is provided substantially at a center of the cover in the first direction; and a first engaging claw that is disposed on an outer side of the cover with respect to the grasping portion in the first direction, and is configured to engage the cover with the housing, wherein the housing includes an engaged portion configured to be engaged with the first engaging claw, and wherein when the grasping portion is operated to remove the cover from the housing, the first engaging claw moves toward the center of the cover in the first direction and engagement of the first engaging claw and the engaged portion is released.

BRIEF DESCRIPTION OF DRAWING

FIG. 5A shows a state in which the cover is mounted on the developing cartridge, and FIG. 5B shows a state in which both outer sides of the cover in a left-right direction are bent.

FIG. 8A shows a state in which engagement of first engaging claws with a mounting portion has been released, and FIG. 8B shows a state in which the cover has been removed from the developing cartridge.

FIG. 9A shows a state in which the cover is mounted on the developing cartridge, and FIG. 9B shows a state in which both outer sides of the cover in a left-right direction are bent.

FIG. 11A shows a state in which engagement of first engaging claws with a mounting portion has been released, and FIG. 11B shows a state in which the cover has been removed from the developing cartridge.

DESCRIPTION OF EXEMPLARY EMBODIMENTS

1. Overall Configuration of Printer

Figure 1:
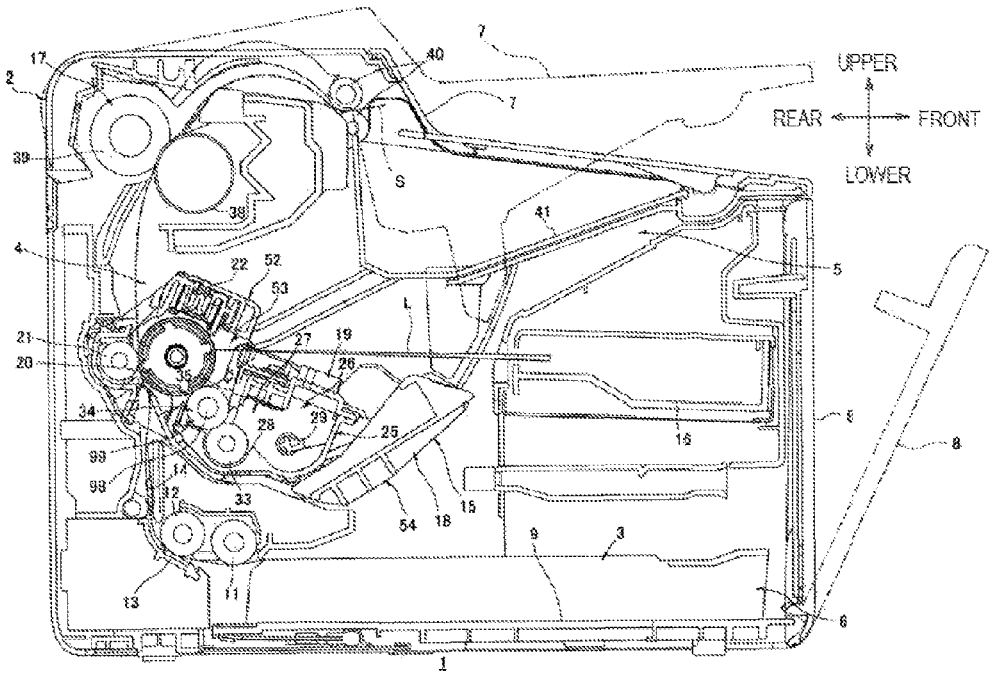
FIG. 1 is a sectional side view illustrating an embodiment of a printer.

As shown in FIG. 1, a printer 1 which is an example of an image forming apparatus includes a main body casing 2.

The main body casing 2 is formed almost in a box shape, and inside the main body casing 2, there are stored a paper feeding unit 3 configured to feed sheets S, and an image forming unit 4 configured to form images on fed sheets S.

In the following description, directions of the printer 1 refer to a state in which the printer 1 is installed in a horizontal direction. That is, the upper side and lower side of the drawing sheet of FIG. 1 are referred to as the upper side and lower side of the printer, respectively. Further, the right side and left side of the drawing sheet of FIG. 1 are referred to as the front side and rear side of the printer. Furthermore, a direction toward a viewer of FIG. 1 is referred to the left side, and a direction away from the view of FIG. 1 is referred to as the right side. A left-right direction is an example of a first direction, and a front-rear direction is an example of a second direction, and a vertical direction is an example of a third direction. Further, the left side is an example of one side of the first direction, and the right side is an example of the other side of the first direction. Furthermore, the front side is an example of one side of the second direction, and the rear side is an example of the other side of the second direction. The upper side is an example of one side of the third direction, and the lower side is an example of the other side of the third direction.

(1) Main Body Casing

At the main body casing 2, a cartridge opening 5 and a sheet opening 6 are formed.

The cartridge opening 5 is formed for attaching or removing a process cartridge 15 (to be described below), and is formed to pass through an upper end portion of the main body casing 2 in the vertical direction. That is, the cartridge opening 5 is formed such that the main body casing 2 is opened upward. The sheet opening 6 is formed for introducing sheets S, and is formed to pass through a lower end portion of a front end portion of the main body casing 2 in the front-rear direction.

The main body casing 2 includes a top cover 7 provided at a lower end portion, and a paper feeding cover 8 provided at a front end portion.

The top cover 7 is provided to be able to swing on its rear end portion between a closing position to close the cartridge opening 5 and an opening position to open the cartridge opening 5. In FIG. 1, the top cover 7 disposed at the closing position is shown by a solid line, and the top cover 7 disposed between the closing position and the opening position is shown by a virtual line.

The paper feeding cover 8 is provided to be able to swing on its lower end portion between a closing position to close the sheet opening 6 and an opening position to open the sheet opening 6. In FIG. 1, the paper feeding cover 8 disposed at the closing position is shown by a solid line, and the paper feeding cover 8 disposed between the closing position and the opening position is shown by a virtual line.

(2) Paper Feeding Unit

The paper feeding unit 3 includes a sheet mounting portion 9 provided at the bottom of the main body casing 2. The sheet mounting portion 9 is connected to the outside of the main body casing 2 through the sheet opening 6.

Then, in a state in which the paper feeding cover 8 is disposed at the opening position, the front portions of sheets S are stacked on the paper feeding cover 8, and the rear portions of the sheets S are stacked inside the sheet mounting portion 9 through the sheet opening 6.

(3) Image Forming Unit

The image forming unit 4 includes the process cartridge 15, a scanner unit 16 which is an example of an exposing means, and a fixing unit 17.

The process cartridge 15 is configured to be attached and removed with respect to the main body casing 2, and is attached to the rear portion of the paper feeding unit 3 inside the main body casing 2. The process cartridge 15 includes a drum cartridge 18 that is configured to be attached and removed with respect to the main body casing 2, and a developing cartridge 19 that is an example of a cartridge and is configured to be attached and removed with respect to the drum cartridge 18.

The drum cartridge 18 includes a photosensitive drum 20, a transfer roller 21, and a scorotron charger 22.

The photosensitive drum 20 is formed in a substantially cylindrical shape extending in the left-right direction, and is rotatably provided at a rear portion of the drum cartridge 18.

The transfer roller 21 is disposed on the rear side of the photosensitive drum 20 such that the transfer roller comes into press contact with the photosensitive drum 20, and is rotatably in the drum cartridge 18.

The scorotron charger 22 is disposed to face the upper front side of the photosensitive drum 20 with a gap.

The photosensitive drum 11 is disposed on the lower front side of the photosensitive drum 20, and includes a developing frame 25 as an example of a housing.

Inside the developing frame 25, a toner container 26 and a developing chamber 27 are defined in parallel in the front-rear direction. The toner container 26 and the developing chamber 27 are connected by a connecting hole 28.

In the toner container 26, toner is stored as an example of developer, and at the central portion of the toner container 26 in the front-rear direction and the vertical direction, an agitator 29 is provided.

The developing chamber 27 includes a developing roller 34 which is an example of a rotating body and a developer image carrier, a feeding roller 33, and a layer-thickness regulating blade 35 which is an example of a layer-thickness regulating member.

The developing roller 34 is rotatably provided at a rear end portion of the developing frame 25 such that an upper portion and rear portion of the developing roller are exposed, and is in contact with the photosensitive drum 20 from the lower front side.

The feeding roller 33 is disposed on the lower front side of the developing roller 34 such that the feeding roller comes into contact with the developing roller 34 from the lower front side, and is rotatably provided on the developing frame 25.

The layer-thickness regulating blade 35 is supported on the developing frame 25 such that the layer-thickness regulating blade comes into contact with the developing roller 34 from the front side.

The scanner unit 10 is disposed on the front side of the process cartridge 15 inside the main body casing 2. The scanner unit 10 emits a laser beam L based on image data toward the photosensitive drum 20, thereby exposing the circumferential surface of the photosensitive drum 20.

The fixing unit 17 is disposed on a rear portion of the drum cartridge 18 inside the main body casing 2. The fixing unit 17 includes a heating roller 38, and a pressing roller 39 that comes into press contact with the heating roller 38 from the upper rear side.

(4) Image Forming Operation

The toner in the toner container 26 of the developing cartridge 19 is fed to the feeding roller 33 through the connecting hole 28 by rotating of the agitator 29, and is fed to the developing roller 34, and is positively charged between the feeding roller 33 and the developing roller 34 by friction.

The thickness of the toner fed on the developing roller 34 is regulated by the layer-thickness regulating blade 35 according to rotating of the developing roller 34, such that the toner is carried as a thin layer of a constant thickness on the surface of the developing roller 34.

Meanwhile, the surface of the photosensitive drum 20 is uniformly charged by the scorotron charger 22, and is exposed by the scanner unit 16. As a result, on the circumferential surface of the photosensitive drum 20, an electrostatic latent image based on image data is formed. Then, the toner carried on the developing roller 34 is fed to the electrostatic latent image formed on the circumferential surface of the photosensitive drum 20, whereby a toner image is carried on the circumferential surface of the photosensitive drum 20.

The sheets S stacked on the sheet mounting portion 9 are sent between a paper feeding roller 12 and a paper feeding pad 13 by rotating of a pickup roller 11, and are separated one by one by rotating of the paper feeding roller 12. Thereafter, each separated sheet S is conveyed to a paper feeding path 14 extending in the vertical direction, and is fed between the photosensitive drum 20 and the transfer roller 21 at a predetermined timing.

Then, each sheet S is conveyed between the photosensitive drum 20 and the transfer roller 21 from the lower side toward the upper side. At this time, an toner image is transferred onto each sheet S, whereby an image is formed.

Subsequently, each sheet S is heated while being pressed when passing between the heating roller 38 and the pressing roller 39. At this time, an image is thermally fixed on the sheet S.

Thereafter, each sheet S is conveyed toward a paper discharging roller 40, and is discharged onto a paper discharge tray 41 formed at the top of the main body casing 2.

Like this, each sheet S passes a conveyance path having substantially a letter "C" shape as seen in a side vide such that each sheet S is fed from the sheet mounting portion 9, passes between the photosensitive drum 20 and the transfer roller 21, and is discharged onto the paper discharge tray 41.

2. Process Cartridge

Figure 2:
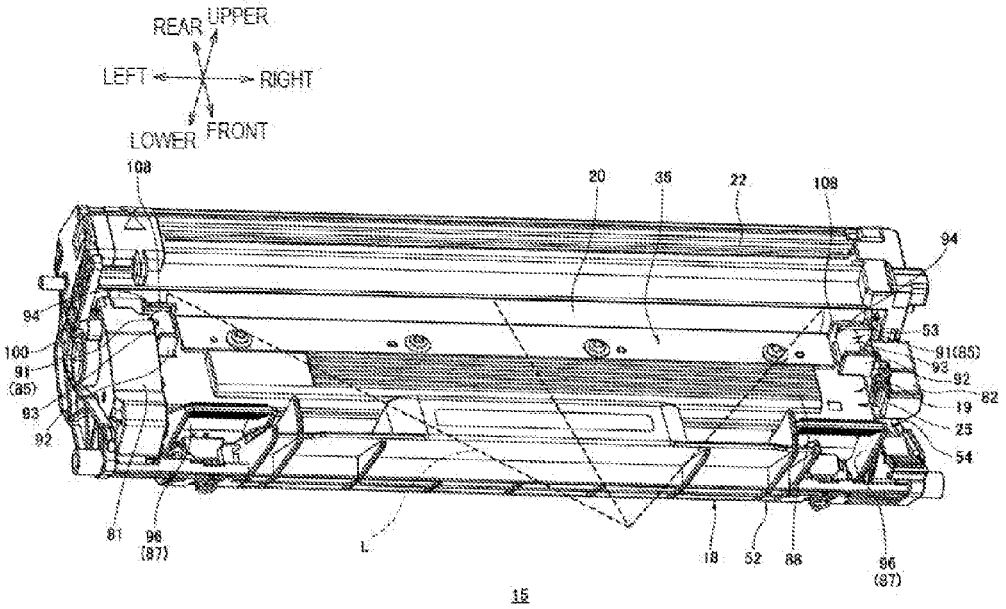
FIG. 2 is a perspective view illustrating a process cartridge shown in FIG. 1 as seen from the upper left side.

As shown in FIG. 2, the process cartridge 15 includes the drum cartridge 18 that is removably attached the main body casing 2, and the developing cartridge 19 that is removably attached to the drum cartridge 18.

In the following description of the process cartridge 15, a side where the photosensitive drum 20 is disposed is referred to as the rear side of the process cartridge 15, and the opposite side thereof is referred to as the front side. Further, a side where the scorotron charger 22 is disposed is referred to as the upper side, and the opposite side thereof is referred to as the lower side.

A front-rear direction is an example of a fourth direction, and a vertical direction is an example of a fifth direction. Further, the rear side is an example of one side of the fourth direction, and the front side is an example of the other side of the fourth direction. Furthermore, the upper side is an example of one side of the fifth direction, and the lower side is an example of the other side of the fifth direction.

That is, a vertical direction and a front-rear direction relative to the process cartridge 15 is slightly different from the vertical direction and the front-rear direction relative to the printer 1, and the process cartridge 15 is attached to the printer 1 such that the rear side of the process cartridge becomes the lower rear side of the printer 1 and the front side of the process cartridge becomes the upper front side of the printer 1.

(1) Drum Cartridge

The drum cartridge 18 includes a drum frame 52.

The drum frame 52 is formed substantially in a bottomed rectangular frame shape, and the rear portion of the drum frame 52 is formed as a drum storing portion 53, and the front portion of the drum frame 52 is formed as a cartridge attaching portion 54.

In the drum storing portion 53, the photosensitive drum 20, the transfer roller 21, and the scorotron charger 22 are stored.

The cartridge attaching portion 54 is formed substantially in a box shape in which the upper side and the rear side are open, such that the cartridge attaching portion 54 allows attachment and removal of the developing cartridge 19.

(2) Developing Cartridge

Figure 3:
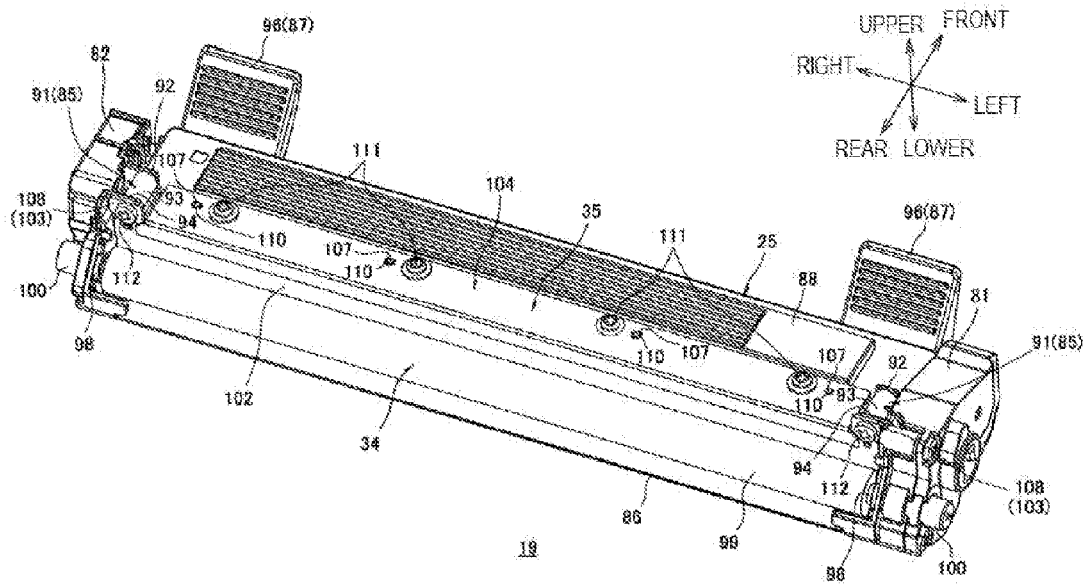
FIG. 3 is a perspective view illustrating a developing cartridge as seen from the upper left side.

As shown in FIG. 3, the developing cartridge 19 includes the above described developing frame 25, a driving unit 81 that is disposed on the left side of the developing frame 25 and transmits a driving force to the feeding roller 33, the developing roller 34, and the agitator 29, and a power supply unit 82 that is disposed on the right side of the developing frame 25 and has electrodes for applying biases to the feeding roller 33 and the developing roller 34.

The developing frame 25 is formed substantially in a box shape extending in the left-right direction. Specifically, the developing frame 25 includes a pair of developing side walls 85, a developing lower wall 86, a developing front wall 87, and a developing upper wall 88.

The paired developing side walls 85 are disposed to face each other with a gap such that the toner container 26 and the developing chamber 27 are interposed therebetween. The developing side walls 85 are formed substantially in a flat plate shape which is substantially rectangular as seen in a side view. At the developing side walls 85, blade holding portions 91 are formed as an example of a positioning unit.

The blade holding portions 91 are formed at rear portions of the developing side walls 85 such that the blade holding portions 91 protrude upward from the upper end portions of the rear portions. Each blade holding portion 91 includes an extending portion 92, a cylindrical portion 93, and a fixed portion 94.

The extending portion 92 is formed in a substantially flat plate shape which is substantially rectangular as seen in a front view and extends upward from the upper end portion of the central portion of a corresponding developing side wall 85 in the front-rear direction.

The cylindrical portion 93 is formed in a substantially cylindrical shape protruding from the rear surface of the extending portion 92 toward the rear side. On the inner circumferential surface of the cylindrical portion 93, threads (not shown) are formed.

The fixed portion 94 is formed in a flat plate shape which is substantially rectangular as seen in a front view and protrudes from the rear surface of the cylindrical portion 93 outward in the circumferential direction of the cylindrical portion 93, and at the central portion of the fixed portion 94, a threaded hole is formed to have almost the same diameter as the inside diameter of the cylindrical portion 93 and be connected to the threads of the inner circumferential surface of the cylindrical portion 93.

Figure 5A:
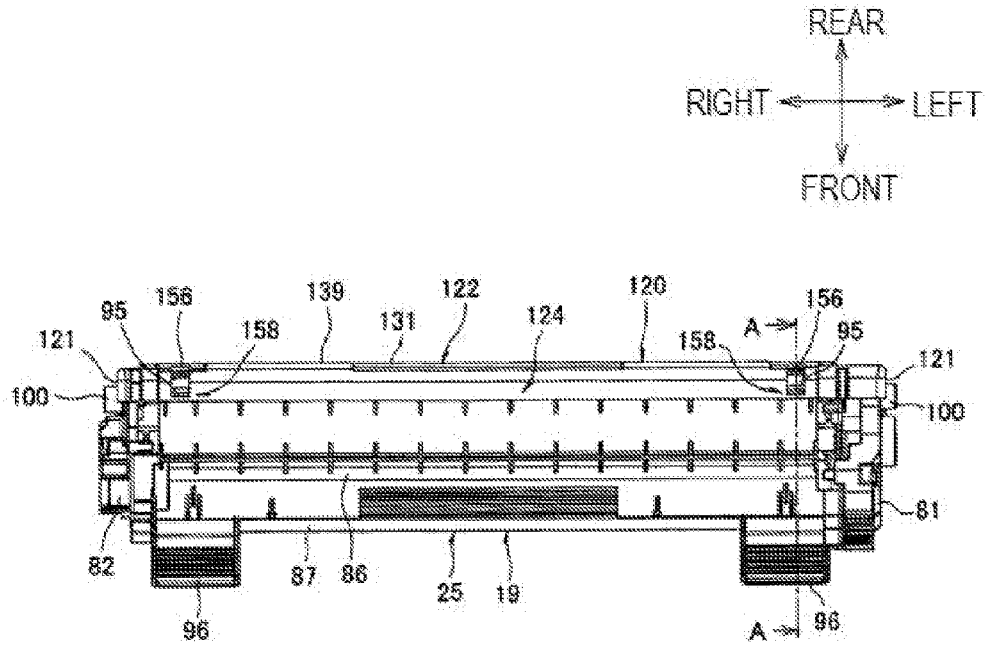
FIG. 5A is a bottom view illustrating the state in which a cover is mounted on the developing cartridge shown in FIG. 3.
Figure 5B:
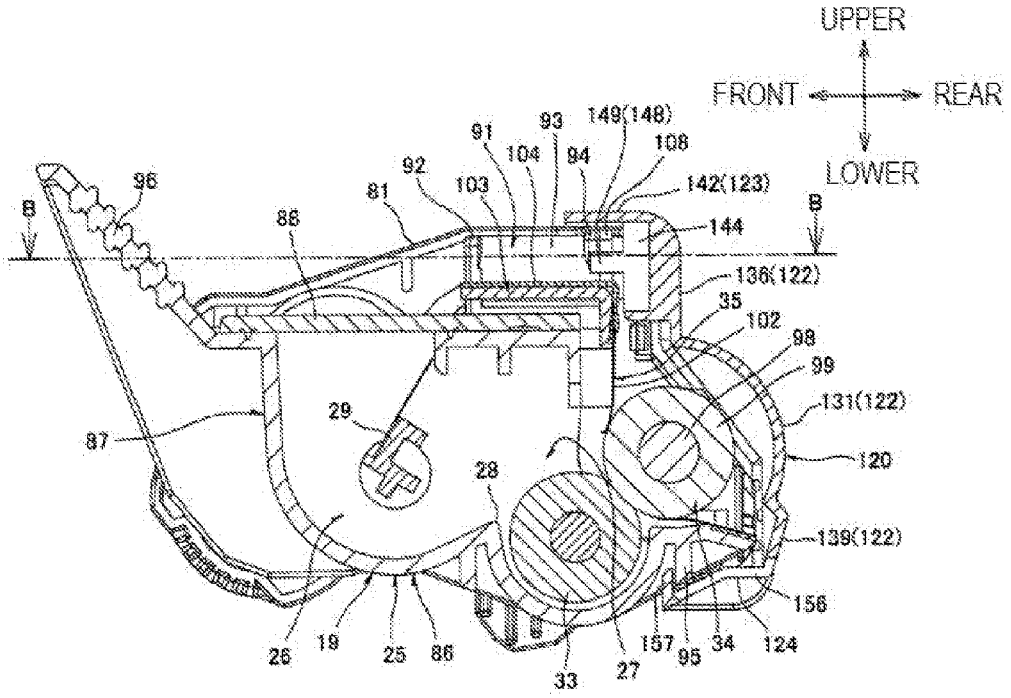
FIG. 5B is a cross-sectional view taken along a line A-A shown in FIG. 5A.

The developing lower wall 86 extends in the left-right direction and is disposed between the lower end portions of both developing side walls 85, and as shown in FIG. 5B, and the rear portion of the developing lower wall 86 is formed according to the outer circumferences of the feeding roller 33 and the developing roller 34, and the front portion of the developing lower wall 86 is formed substantially in an arc shape as seen in a cross-sectional view, according to the rotation trajectory of the agitator 29. The developing lower wall 86 includes a locking wall 95.

The locking wall 95 is formed at a rear portion of the developing lower wall 86 in a flat plate shape which is substantially rectangular as seen in a front view, extends along the left-right direction, and protrude downward.

The developing front wall 87 is formed in a substantially flat plate shape extending upward from the front end portion of the developing lower wall 86 and disposed between the front end portions of both developing side walls 85. On the developing front wall 87, developing grasping portions 96 is provided.

As shown in FIG. 3, one developing grasping portion 96 is provided at each of the left and right end portions of the developing front wall 87.

The developing upper wall 88 is formed in a substantially flat plate shape extending in the left-right direction, and is disposed on the upper end portions of the developing side walls 85 and the developing front wall 87 such that the developing upper wall 88 faces them. The circumferential edge portion of the developing upper wall 88 is fixed to the upper end portions of the developing side walls 85 and the developing front wall 87 by a method such as welding.

On the pair of the developing side walls 85 of the developing frame 25, the developing roller 34 is supported. Specifically, the developing roller 34 includes a developing roller shaft 98 which is an example of a rotating shaft, and a rubber roller 99 that covers the developing roller shaft 98. Further, both end portions of the developing roller shaft 98 are disposed at the rear end portions of corresponding developing side walls 85, respectively, and protrude outward in the left-right direction so as to pass through the developing side walls 85, whereby the developing roller 34 is supported to be relatively rotatable with respect to the pair of the developing side walls 85.

Onto both end portions of the developing roller shaft 98 protruding from the pair of developing side walls 85, a collar member 100 formed to extend in parallel to the rotation trajectory of the developing roller shaft 98 is fit.

The layer-thickness regulating blade 35 includes a blade member 102 that regulates the layer thickness of toner carried on the rubber roller 99, a supporting member 103 that supports the blade member 102, and a reinforcing member 104 that reinforces the blade member 102.

The blade member 102 is made of a thin and rigid metal plate in a flat plate shape which is substantially rectangular as seen in a front view and extends in the left-right direction.

As shown in FIG. 5B, the supporting member 103 is made of a metal plate thicker than the blade member 102 substantially in a letter "L" shape as seen in a sectional side view. Specifically, the supporting member 103 includes a horizontal portion extending in the front-rear direction, and vertical portions extending downward from the front end portion of the horizontal portion. The horizontal portion of the supporting member 103 has a supporting member side threaded hole (not shown), and positioning protrusions 107 as shown in FIG. 3, and the vertical portions of the supporting member 103 have mounting portions 108.

Figure 7A:
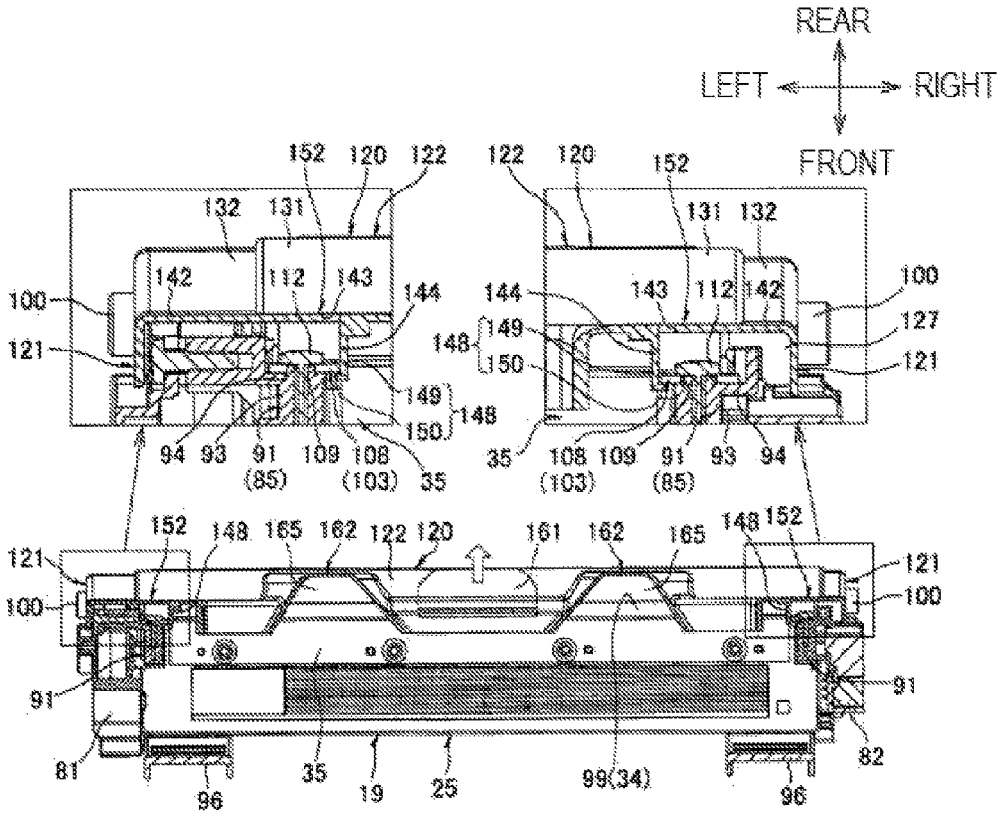
FIGS. 7A and 7B are explanatory views illustrating a section along a line B-B shown in FIG. 5B for explaining removal of the cover from the developing cartridge. More specifically.
Figure 7B:
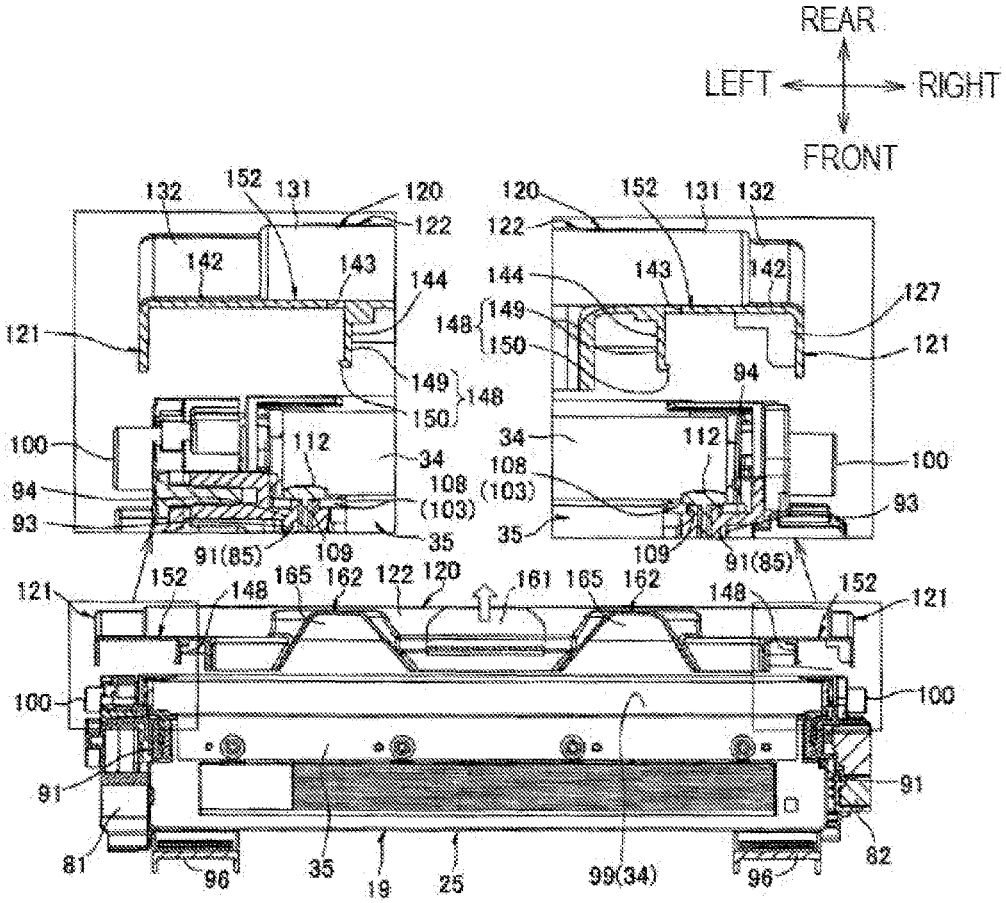

The mounting portions 108 are formed at both end portions of the supporting member 103 in the left-right direction in flat plate shapes which are substantially rectangular as seen in a front view and protrude upward from the upper end edges of the vertical portions of the supporting member 103. At the mounting portions 108, as shown in FIGS. 7A and 7B, mounting holes 109 are formed to pass through the mounting portions 108 in the thickness directions of the mounting portions 108, that is, in the front-rear direction.

Similarly to the supporting member 103, as shown in FIG. 5B, the reinforcing member 104 is made of a metal plate or the like thicker than the blade member 102 substantially in a letter "L" shape as seen in a sectional side view, and has a horizontal portion extending in the front-rear direction, and vertical portions extending downward from the front end portion of the horizontal portion. At the horizontal portion of the reinforcing member 104, a reinforcing member side threaded hole (not shown) and positioning holes 110 are formed as shown in FIG. 3.

The inside diameter of each positioning hole 110 is slightly larger than the outside diameter of each positioning protrusion 107.

As shown in FIG. 5B, the blade member 102 is mounted on the rear surfaces of the vertical portions of the supporting member 103, and the reinforcing member 104 is assembled with the supporting member 103 such that the reinforcing member covers the supporting member 103 from the above. Specifically, the positioning protrusions 107 are inserted into the positioning holes 110 as shown in FIG. 3, such that the horizontal portions of the supporting member 103 and the reinforcing member 104 face each other in the vertical direction and the vertical portions of the supporting member 103 and the reinforcing member 104 face each other in the front-rear direction. Therefore, between the vertical portions of the supporting member 103 and the vertical portions of the reinforcing member 104, the upper end portion of the blade member 102 is interposed.

As shown in FIG. 3, screws 111 are screwed into the supporting member side threaded holes (not shown) of the supporting member 103 and the reinforcing member side threaded holes (not shown) of the reinforcing member 104. As a result, the supporting member 103 and the reinforcing member 104 are fixed to each other with the blade member 102 interposed therebetween, whereby the layer-thickness regulating blade 35 is formed.

Then, the mounting portions 108 of the supporting member 103 of the layer-thickness regulating blade 35 are mounted on the blade holding portions 91 of both developing side walls 85. Specifically, as shown in FIG. 7, the front surfaces of the mounting portions 108 and the rear surfaces of the fixed portions 94 of the blade holding portions 91 are brought into contact with each other such that the mounting holes 109 of the mounting portions 108 face the threaded holes (not shown) of the fixed portions 94, and screws 112 are screwed with the threads formed in the inner circumferential surfaces of the cylindrical portions 93, whereby the layer-thickness regulating blade 35 is fixed to the blade holding portions 91 of the developing frame 25.

3. Attachment and Removal of Developing Cartridge with Respect to Drum Cartridge In order to attach the developing cartridge 19 to the drum cartridge 18, as shown in FIG. 2, the developing grasping portion 96 of the developing cartridge 19 is grasped, and the rear end portion of the developing cartridge 19 is inserted into the cartridge attaching portion 54 of the drum cartridge 18 from above. [0093]

As a result, attachment of the developing cartridge 19 to the cartridge attaching portion 54 is completed, and the process cartridge 15 is formed.

4. Attachment of Process Cartridge into the Main Body Casing

In order to attach the process cartridge 15 to the main body casing 2, first, as shown in FIG. 1 and described above, the top cover 7 of the main body casing 2 is disposed at the opening position.

Next, the process cartridge 15 is inserted into the main body casing 2 through the cartridge opening 5.

As a result, attachment of the process cartridge 15 into the main body casing 2 is completed.

At this time, the photosensitive drum 20 of the process cartridge 15 is exposed such that the front portion of the photosensitive drum 20 can be exposed by the laser beam L emitted from the scanner unit 16.

Specifically, as shown in FIG. 2, the laser beam L is emitted from the scanner unit 16 toward the rear side, thereby exposing the front end portion of the photosensitive drum 20.

At this time, the developing cartridge 19 is disposed below the emission trajectory of the laser beam L, and the scorotron charger 22 is disposed above the emission trajectory of the laser beam L. Of the developing cartridge 19, the pair of blade holding portions 91 of the developing side walls 85 and the pair of mounting portions 108 of the layer-thickness regulating blade 35 are disposed on the outside from the emission trajectory of the laser beam L in the left-right direction. That is, of the developing cartridge 19, the pair of blade holding portions 91 of the developing side walls 85 and the pair of mounting portions 108 of the layer-thickness regulating blade 35 are disposed so as not to block the laser beam L.

5. Configuration of Cover

Figure 4:
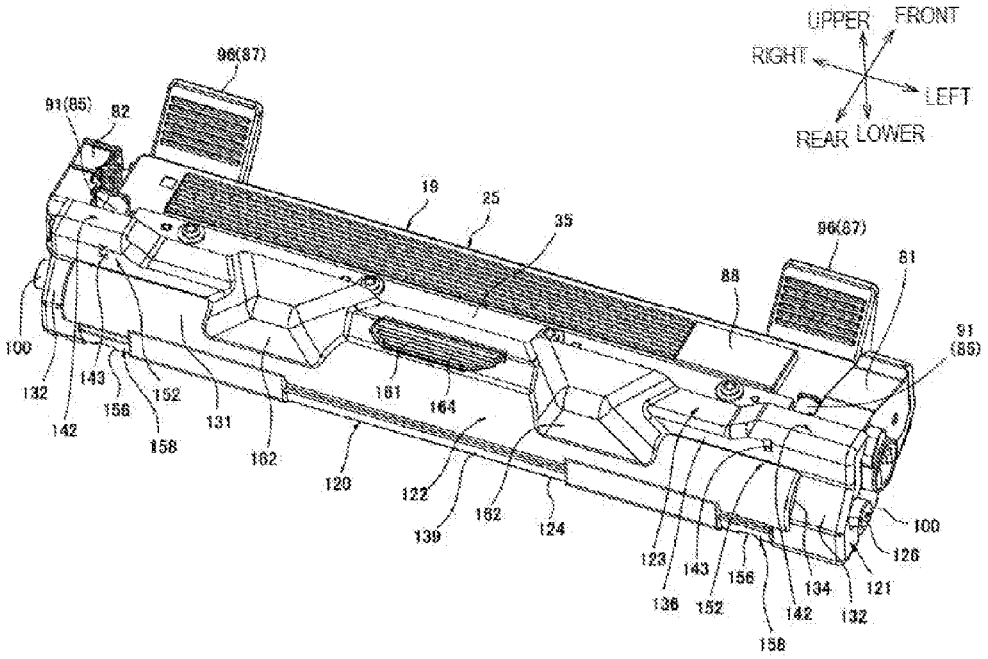
FIG. 4 is a perspective view illustrating a state in which a cover is mounted on the developing cartridge shown in FIG. 3, as seen from the upper left side.

During shipment and transportation of the developing cartridge 19, as shown in FIGS. 4, 5A, and 5B, a cover 120 is mounted on the rear end portion of the developing frame 25 so as to protect the developing roller 34 exposed from the developing frame 25.

Figure 6:
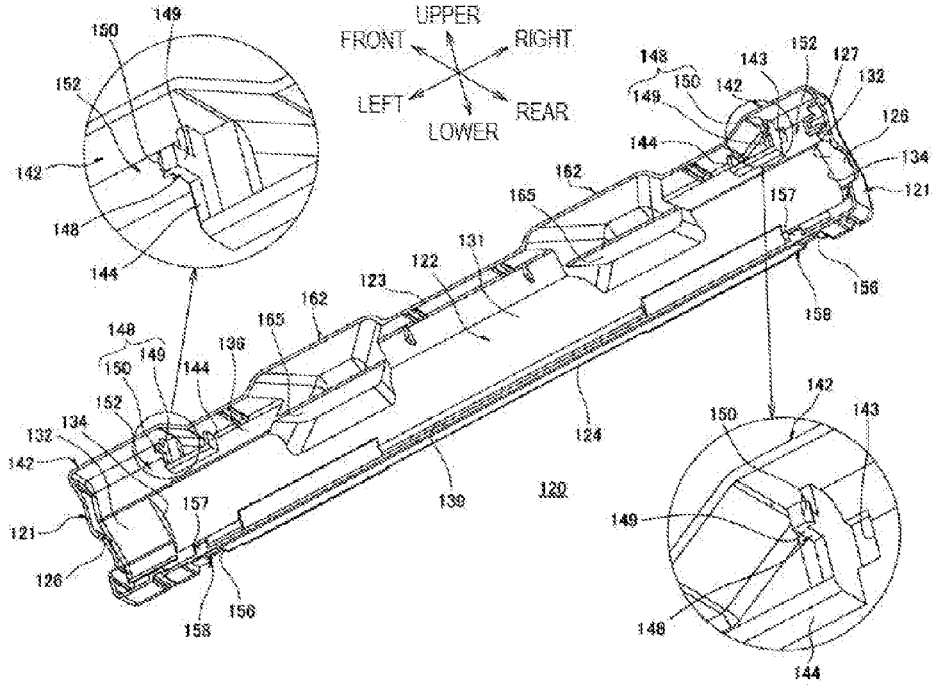
FIG. 6 is a perspective view the cover shown in FIG. 4, as seen from the front.

As shown in FIGS. 5A, 5B, and 6, the cover 120 is flexible, and is made of a polymer material such as a resin material (for example, a polypropylene material), and integrally has cover side walls 121 which are an example of a pair of side walls, a cover main portion 122, a cover upper wall 123, and a cover lower wall 124.

The paired cover side walls 121 are formed in a flat plate shape which is substantially rectangular as seen in a sectional side view and extends in the vertical direction, and are disposed to face each other with a gap in the left-right direction. At the cover side walls 121, collar receiving grooves 126 are formed.

The collar receiving grooves 126 are formed substantially in a letter "U" shape as seen in a side view, such that the front side is open and the collar receiving grooves 126 are recessed toward the rear side, and thus can receive the collar member 100 in a state where the cover 120 has been mounted on the developing cartridge 19.

Figure 8A:
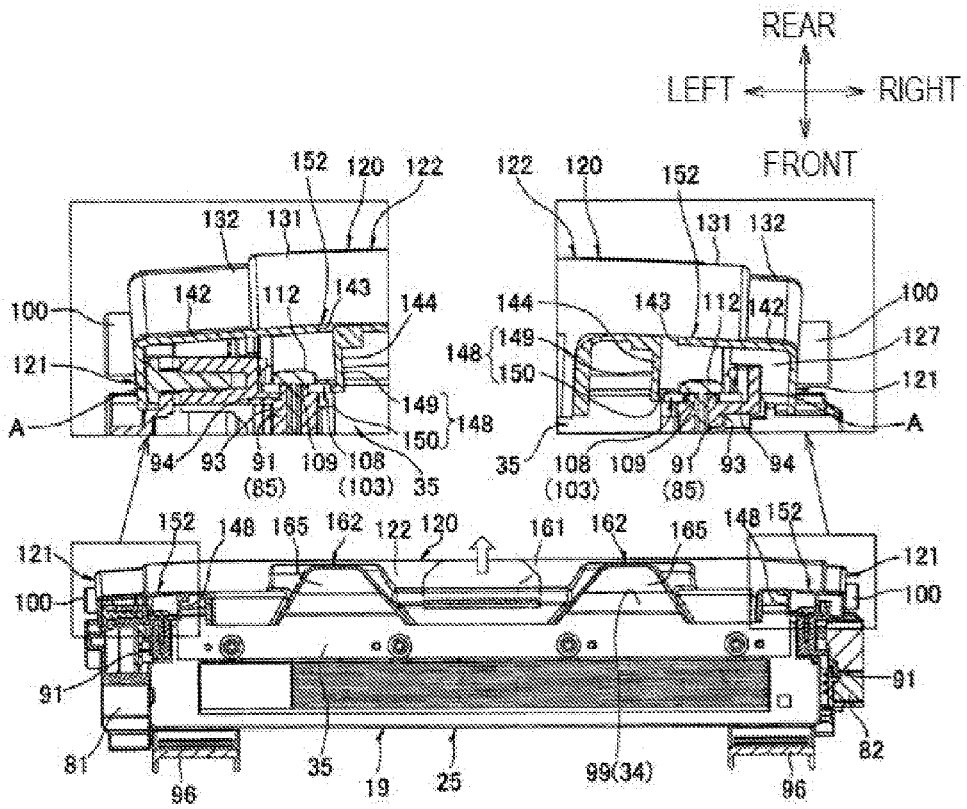
FIGS. 8A and 8B are explanatory views for further explaining removal of the cover from the developing cartridge. More specifically.
Figure 8B:
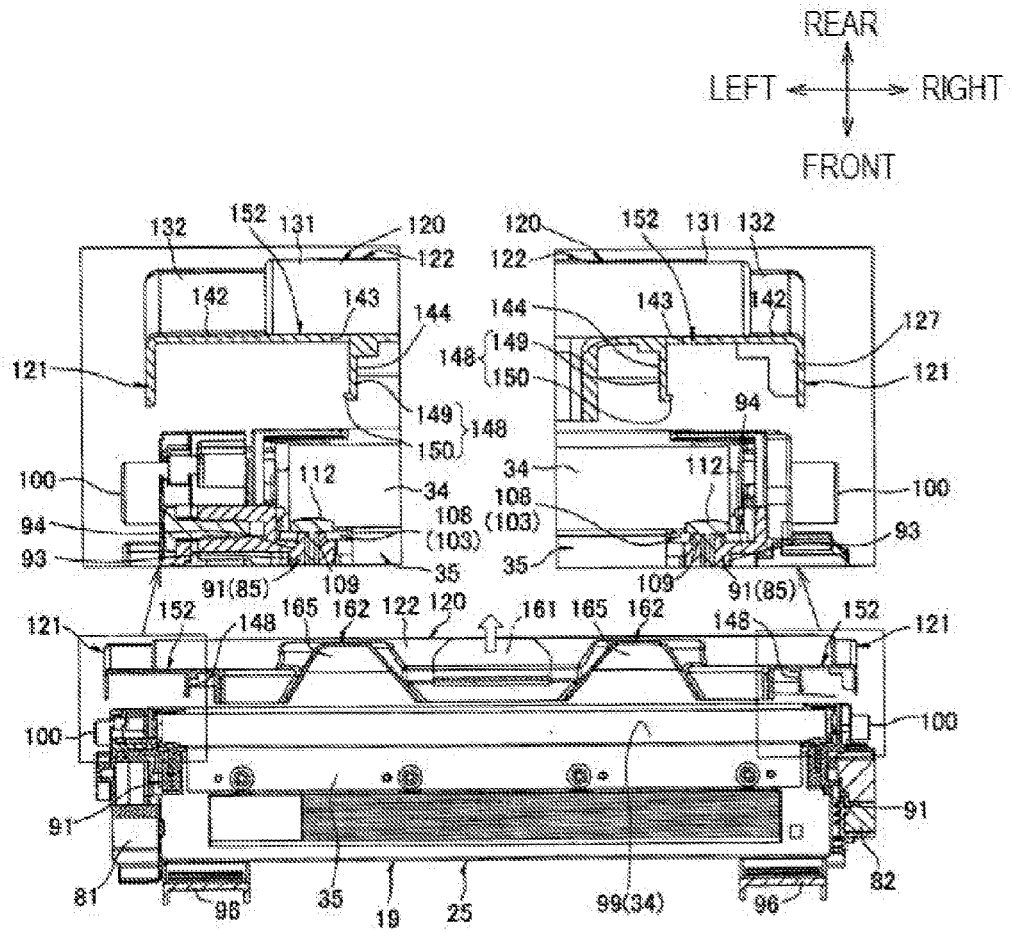
Figure 9A:
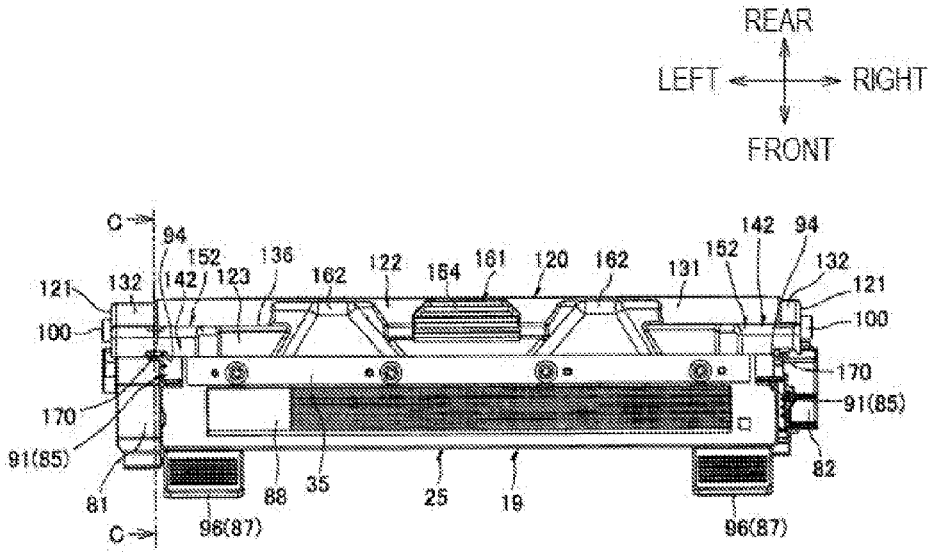
FIG. 9A is a plan view illustrating the developer carrier on which a cover of a second embodiment has been mounted.
Figure 9B:
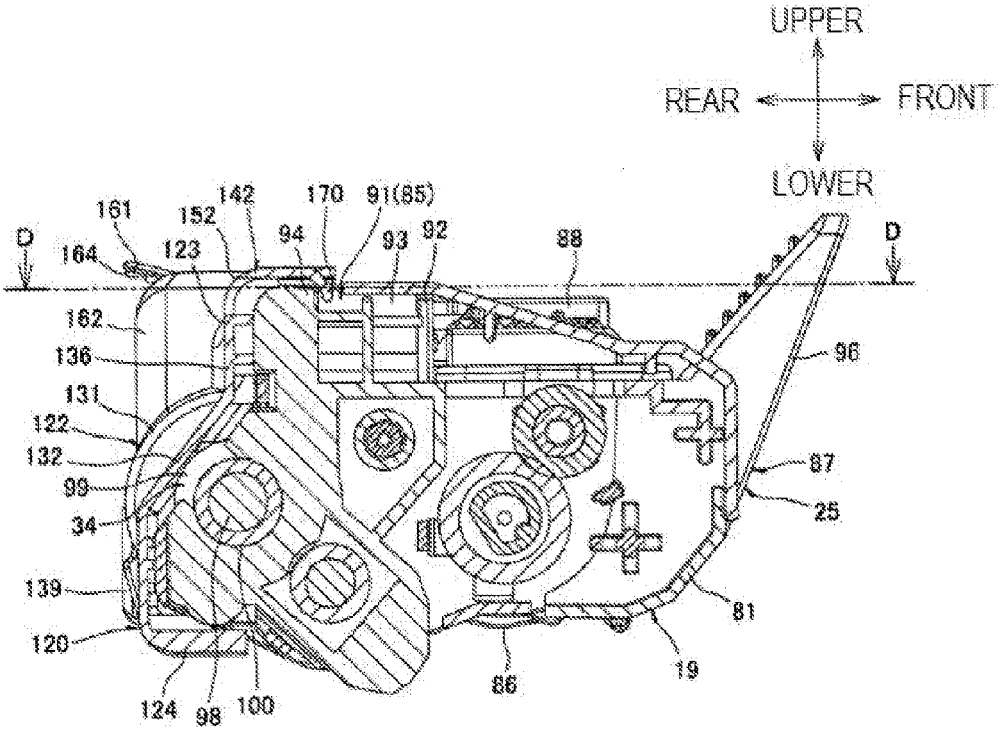
FIG. 9B is a cross-sectional view taken along a line C-C shown in FIG. 9A.

The left cover side wall 121 has a rib 127 as shown in FIGS. 6 and 8B.

The rib 127 is formed in a flat plate shape which has substantially a letter "L" shape as seen in a plan view such that the rib extends toward the right side from the left surface of the upper portion of the right cover side wall 121, and the rear portion of the rib extends toward the left side along the front surface of the horizontal portion of a corresponding bulging portion 142 (to be described below).

The cover main portion 122 is integrally disposed between the rear end portions of both cover side walls 121 as shown in FIGS. 5A, 5B, and 6. The cover main portion 122 has a cover portion 131, a pair of cover side portions 132, an upper flat plate portion 136, and a lower flat plate portion 139.

The cover portion 131 is formed substantially in an arc shape such that the cover portion extends in the left-right direction, bulges toward the rear side, and extends along the circumferential surface of the rubber roller 99 of the developing roller 34. The length of the cover portion 131 in the left-right direction is slightly larger than the length of the rubber roller 99 of the developing roller 34 in the left-right direction.

The cover side portions 132 are formed in a substantially rectangular shape as seen in a front view, such that the cover side portions extend toward both outer sides in the left-right direction so as to be continuous from the both outer sides of the cover portion 131 in the left-right direction to the pair of cover side walls 121, and inclines toward the front side along a direction from the lower side to the upper side.

Both outer end portions of the cover portion 131 in the left-right direction and both inner end portions of both cover side portions 132 in the left-right direction are connected, respectively, by connecting portions 134 having substantially a semi-disk shape as seen in a side view.

The upper flat plate portion 136 is formed in a flat plate shape which is substantially rectangular as seen in a rear view such that the upper flat plate portion extends continuously from the upper end portions of the upper end portions of both cover side portions 132 and the cover portion 131 in the left-right direction.

The lower flat plate portion 139 is formed in a flat plate shape which is substantially rectangular as seen in a rear view such that the lower flat plate portion extends continuously from the upper end portions of the lower end portions of both cover side portions 132 and the cover portion 131 in the left-right direction.

The cover upper wall 123 is bent toward the front side continuously from the upper portion of the upper flat plate portion 136, and is integrally disposed between the upper end portions of both cover side walls 121. At both end portions of the cover upper wall 123, the bulging portions 142 bulging toward the upper side are formed.

Each bulging portion 142 has a horizontal portion extending in the left-right direction, and a vertical portion extending downward from the rear end portion of the horizontal portion. At both inner end portions of the vertical portion of each bulging portion 142 in the left-right direction, cutout holes 143 are formed in a substantially rectangular as seen in a front view so as to pass through the inner end portions in the thickness direction, that is, in the front-rear direction.

Extending portions 144 are formed to be adjacent to the inner sides of the cutout hole 143 in the left-right direction.

Each extending portion 144 is formed substantially in a letter "U" shape such that the extending portion extends from the front surface of the vertical position of a corresponding bulging portion 142 toward the front side across the front surface of the upper flat plate portion 136. The upper end edge of each extending portion 144 on the outer side in the left-right direction continues from the lower surface of the horizontal portion of a corresponding bulging portion 142, and the upper end edge of each extending portion 144 on the inner side in the left-right direction continues from the lower surface of a portion of the cover upper wall 123 positioned on the inner side from a bulging portion 142 in the left-right direction. At the extending portions 144, first engaging claws 148 are formed. That is, a pair of first engaging claws 148 is provided with a gap in the left-right direction.

At the outer portions of the extending portions 144 in the left-right direction, the first engaging claws 148 are disposed substantially at the centers in the centers of the outer portions in the vertical direction. The length between the pair of first engaging claws 148 is larger than an area of the photosensitive drum 20 where an electrostatic latent image is formed, and is smaller than the length between the pair of blade holding portions 91 and the length between the pair of mounting portions 108. Each first engaging claw 148 has a leg portion 149 and a claw portion 150.

The leg portion 149 is formed substantially in a rod shape so as to protrude from the front surface of the extending portions 144 toward the front side.

The claw portion 150 is formed so as to protrude from the outer surface of the front end portion of the leg portion 149 in the left-right direction toward the outer side in the left-right direction as shown in FIGS. 7A and 7B. Specifically, the claw portion 150 is formed substantially in a right triangle shape such that the rear surface of the claw portion extends along the left-right direction, and the front surface of the claw portion becomes an inclined surface inclining toward the rear side along a direction toward the outer side in the left-right direction.

Like this, as shown in FIGS. 4 and 6, in the bulging portions 142, areas where the first engaging claws 148 are formed are defined as first engaging claw formation areas 152.

As shown in FIGS. 5A, 5B, and 6, the cover lower wall 124 continues from the lower end portion of the lower flat plate portion 139, is bent toward the front side, and is integrally disposed between the lower end portions of both cover side walls 121. At both end portions of the cover lower wall 124 in the left-right direction, slits 156 are formed toward the front side such that rear end portions of the cover lower wall 124 are open. At the front end surface of the cover lower wall 124, second engaging claws 157 are provided in a substantially rectangular shape as shown in a front view such that the second engaging claws protrude upward from the upper surfaces of front portions of the slits 156. That is, a pair of second engaging claws 157 is provided with a gap in the left-right direction.

Like this, areas of the cover lower wall 124 where the second engaging claws 157 are formed are defined as second engaging claw formation areas 158.

Further, as shown in FIGS. 4 and 6, at the cover 120, a cover grasping portion 161 which is an example of a grasping portion, and a protruding portion 162 are provided.

The cover grasping portion 161 is formed in a flat plate shape which is substantially rectangular as seen in a plan view such that the cover grasping portion protrudes toward the upper rear side from the substantially central portion of a connection of the upper flat plate portion 136 of the cover main portion 122 and the cover upper wall 123, and is formed in a tapered shape such that the width of the cover grasping portion, that is, the length of the cover grasping portion in the left-right direction decreases from the substantially central portion in the front-rear direction toward the rear side. That is, the cover grasping portion 161 is provided on the first engaging claw (148) side in the vertical direction of the cover 120.

On the cover grasping portion 161, elongated protrusions 164 are formed.

A plurality of elongated protrusions 164 are linearly formed to extend in a left-right direction from the upper side of the cover grasping portion 161, and are disposed at intervals in the front-rear direction.

The pair of protruding portions 162 is provided from both end portions of the cover grasping portion 161 in the left-right direction toward the outer side in the left-right direction with a gap. The protruding portions 162 are formed throughout the cover portion 131, the upper flat plate portion 136, and the cover upper wall 123 so as to protrude toward the upper rear side. The protruding portions 162 are formed such that the upper surfaces thereof are in parallel to the upper surface of the cover upper wall 123, and the lower surfaces thereof are in parallel to the rear surface of the lower flat plate portion 139.

The inner surfaces of the protruding portions 162 in the left-right direction are formed to incline outward in the left-right direction along a direction from the front side to the rear side. The outer surfaces of the protruding portions 162 are formed to incline inward in the left-right direction along the direction from the front side to the rear side.

The protruding portions 162 have reinforcing ribs 165.

The reinforcing ribs 165 are formed such that they are disposed in spaces defined inside the protruding portions 162, and protrude from the inner surfaces of the protruding portions 162 toward the developing roller 34, and are disposed between the left and right inner surfaces.

Like this, the protruding portions 162 and the reinforcing ribs 165 are formed, and in the cover main portion 122, the cover portion 131, the upper flat plate portion 136, and the lower flat plate portion 139 are formed in a stepwise fashion. Therefore, the cover 120 has high rigidity. Since the horizontal portions of the bulging portions 142 and the upper flat plate portion 136 form an even and flat surface, when a force in a front-rear direction is applied to the cover 120, the first engaging claw formation areas 152 are likely to be bent in the front-rear direction plane the first engaging claws 148 with respect to the vicinities of both outer sides of the extending portions 144 of the bulging portions 142 in the left-right direction. That is, the rigidity of the first engaging claw formation areas 152 of the cover 120 is lower than that of the other portion of the cover 120. Since the rigidity of the first engaging claw formation areas 152 of the cover 120 is lower than that of the other portion of the cover 120, the second engaging claw formation areas 158 have rigidity higher than that of the first engaging claw formation areas 152.

6. Mounting and Removal of Cover with Respect to Developing Cartridge

Subsequently, mounting of the cover 120 on the developing cartridge 19 will be described.

In order to mount the cover 120 on the developing cartridge 19, as shown in FIG. 4, the cover grasping portion 161 of the cover 120 is grasped and the cover 120 is assembled from the rear side of the developing cartridge 19 such that the collar member 100 and the collar receiving grooves 126 correspond to each other.

At this time, first, as shown in FIG. 5B, the lower side of the cover 120 is brought close to the developing cartridge 19, and the second engaging claw formation areas 158 of the cover lower wall 124 are locked at both outer portions of the locking wall 95 of the developing lower wall 86 in the left-right direction.

Next, the cover 120 is swung on the second engaging claws 157 counterclockwise as seen in a right side view. As a result, the inclined surfaces of the claw portions 150 of the first engaging claws 148 and the mounting portions 108 of the layer-thickness regulating blade 35 come into contact with each other. Then, as the inclined surfaces of the claw portion 150 slide on the mounting portions 108, the leg portions 149 of the first engaging claws 148 are elastically deformed inward in the left-right direction so as to disposed inward in the left-right direction by the length of the claw portions 150 in the left-right direction as shown in FIG. 8A. As a result, the claw portions 150 are disposed on the inner side from the mounting portions 108 in the left-right direction.

Further, if the cover 120 is swung counterclockwise as seen in a right side view, the claw portions 150 are moved toward the front side while being on the inner side from the mounting portions 108 in the left-right direction, and the rear surfaces of the claw portions 150 are flush with the front surfaces of the mounting portions 108. Then, as shown in FIG. 7B, the leg portions 149 are restored, and the rear surfaces of the claw portions 150 and the front surfaces of the mounting portions 108 come into contact with each other. As a result, as shown in FIG. 7A, the first engaging claws 148 are locked by the blade holding portions 91. That is, the mounting portions 108 of the layer-thickness regulating blade 35 are configured as examples of engaged portions with which the first engaging claws 148 are engaged.

In this way, mounting of the cover 120 with respect to the developing cartridge 19 is completed.

In order to remove the cover 120 from the developing cartridge 19, the cover is operated in the procedure reverse to that of the above described mounting operation.

Specifically, as shown in FIG. 7A, the cover grasping portion 161 is grasped, and the cover 120 is pulled toward the rear side. Then, the cover 120 is swung on the second engaging claws 157 clockwise as seen in a right side view. Since the first engaging claws 148 are provided on the upper side of the cover 120 similarly to the cover grasping portion 161, if the cover 120 is pulled toward the rear side, the first engaging claws 148 are swung toward the rear side.

Then, since the rigidity of the first engaging claw formation areas 152 of the cover 120 is lower than that of the other portion of the cover 120, as shown in FIG. 7B, the claw portions 150 of the first engaging claws 148 comes into contact with the mounting portions 108 from the front side, whereby the first engaging claw formation areas 152 are elastically deformed such that the central portion of the cover 120 in the left-right direction extends toward the rear side.

Therefore, both outer portions of the cover 120 in the left-right direction incline toward the front side along a direction toward the outer side in the left-right direction.

If the cover 120 is further pulled toward the rear side, on the left surface of the cover 120, the cover side walls 121 and the developing side walls 85 of the developing frame 25 come into contact with each other, and on the right side of the cover 120, the rib 127 and the developing side walls 85 of the developing frame 25 come into contact with each other. The contact portions of the developing side walls 85 with the cover 120 are referred to as contact portions A.

Subsequently, if the cover 120 is further pulled toward the rear side, as shown in FIG. 8A, as both outer portions of the cover 120 in the left-right direction are elastically deformed, the leg portions 149 of the first engaging claws 148 are swung on the contact portions A so as to be inclined inward in the left-right direction along a direction toward the front side. In other words, the first engaging claws 148 are moved to the center side of the cover 120 in the left-right direction toward the cover grasping portion 161. That is, the contact portions A increase the movement amounts of the first engaging claws 148 toward the center side of the first engaging claws 148 in the left-right direction with the contact portions A serving as fulcrums.

Therefore, the contact of the claw portions 150 with respect to the mounting portions 108 is released, and the engagement of the first engaging claws 148 with respect to the developing frame 25 is released.

As the cover 120 is further pulled toward the rear side, engagement of the second engaging claws 157 with respect to the locking wall 95 is released. Therefore, as shown in FIG. 8B, the cover side walls 121 and the developing side walls 85 are separated from each other, and the cover 120 is restored.

In this way, removal of the cover 120 from the developing cartridge 19 is completed.

7. Effects (1) According to the developing cartridge 19, as shown in FIGS. 7A to 8B, when the flexible cover 120 has been mounted on the developing frame 25, the first engaging claws 148 are in engagement with the mounting portions 108. Meanwhile, when the flexible cover 120 is removed from the developing frame 25, if the cover grasping portion 161 is pulled toward the rear side, both outer portions of the cover 120 bend, whereby the first engaging claws 148 moves toward the center side along the left-right direction such that engagement with the developing frame 25 is released.

In other words, if the cover grasping portion 161 is not pulled toward the rear side, the first engaging claws 148 are in firm engagement with the mounting portions 108.

Meanwhile, as the cover grasping portion 161 is pulled toward the rear side, the first engaging claws 148 are swung toward the center side along the left-right direction, that is, the first engaging claws 148 are separated from the mounting portions 108 disposed on the outer side in the left-right direction. Therefore, it s possible to easily release engagement of the cover 120 and the developing frame 25.

As a result, during mounting of the cover 120 on the developing frame 25, since the first engaging claws 148 are in firm engagement with the mounting portions 108, it is possible to securely protect the developing roller 34 by the cover 120, and during removal, since the engagement of the first engaging claws 148 with the mounting portions 108 is released by operating the cover grasping portion 161 in the front-rear direction, it is possible to easily remove the cover 120 from the developing frame 25.

(2) According to the developing cartridge 19, as shown in FIGS. 7A to 8B, the claw portions 150 of the first engaging claws 148 are formed outward from the inner side in the left-right direction. That is, the first engaging claws 148 are open toward the outer side in the left-right direction.

Therefore, if the cover grasping portion 161 is pulled toward the rear side, the first engaging claws 148 are smoothly swung toward the inner side in the left-right direction.

As a result, it is possible to easily separate the first engaging claws 148 from the mounting portions 108, and to easily remove the cover 120 from the developing frame 25.

(3) According to the developing cartridge 19, as shown in FIG. 6, on the upper side of the cover 120, the cover grasping portion 161 and the first engaging claws 148 are provided, and on the lower side of the cover 120, the second engaging claws 157 are provided. Therefore, when the cover grasping portion 161 is operated to separate the first engaging claws 148 from the mounting portions 108, it is possible to the cover 120 is swung on the second engaging claws 157 clockwise as seen in the right side view, thereby removing the cover 120 from the developing frame 25.

Therefore, when the cover 120 is removed from the developing frame 25, it is possible to suppress the cover 120 from bending toward the developing roller 34, and to suppress a portion of the cover 120 from coming into contact with the developing roller 34.

As a result, it is possible to remove the cover 120 from the developing frame 25 while securely protecting the developing roller 34.

(4) According to the developing cartridge 19, as shown in FIGS. 7A to 8B, since the rigidity of the first engaging claw formation areas 152 of the cover 120 is lower than that of the other portion of the cover 120, when the cover grasping portion 161 is operated to remove the cover 120, it is possible to bend the first engaging claw formation areas 152 more than the other portion of the cover 120.

Therefore, when the cover grasping portion 161 is operated, it is possible to positively swing the first engaging claws 148 toward the center. Thus, it is possible to release engagement of the first engaging claws 148 with the mounting portions 108 with a small force.

As a result, it is possible to easily remove the cover 120 from the developing frame 25.

(5) According to the developing cartridge 19, as shown in FIGS. 4 and 6, since the rigidity of the second engaging claw formation areas 158 is higher than the rigidity of the first engaging claw formation areas 152, even if the cover grasping portion 161 is operated to positively move the first engaging claws 148 toward the center, it is possible to maintain the engagement of the second engaging claws 157 with the developing frame 25.

Therefore, it is possible to surely remove the cover 120 with the second engaging claws 157 serving as a fulcrum.

(6) According to the developing cartridge 19, as shown in FIG. 2, even if the developing cartridge 19 having the mounting portions 108 for allowing the first engaging claws 148 to be engaged with respect to the developing frame 25 is attached to the main body casing 2, in the printer 1, the mounting portions 108 do not block the laser beam L from the scanner unit 16.

Therefore, during shipment and transportation of the developing cartridge 19, it is possible to engage the first engaging claws 148 with the mounting portions 108, thereby surely mounting the cover 120 won the developing frame 25, and during use, it is possible to remove the cover 120 from the developing frame 25 and attach the developing cartridge 19 to the main body casing 2 such that the developing cartridge does not block the laser beam L.

(7) According to the developing cartridge 19, as shown in FIGS. 7A and 7B, it is possible to engage the first engaging claws 148 with the mounting portions 108 of the layer-thickness regulating blade 35. That is, it is possible to configure the mounting portions 108 as engaged portions.

Therefore, as compared to a case where the layer-thickness regulating blade 35 is configured such that a member for assembling with the developing frame 25 and a member to be engaged with the first engaging claws 148 are separate, it is possible to reduce the number of components of the developing cartridge 19.

(8) According to the developing cartridge 19, as shown in FIGS. 7A to 8B, the developing frame 25 has the contact portions A to come into contact with the developing side walls 85 when the cover 120 is removed from the developing frame 25. Further, the contact portions A increase the movement amount of the first engaging claws 148 toward the center in the left-right direction with the contact portions A serving as a fulcrum.

Therefore, it is possible to easily separate the first engaging claws 148 from the mounting portions 108 with the contact portions A serving as a fulcrum.

8. Second Embodiment

A second embodiment of the cover will be described with reference to FIGS. 9A to 11B. In the second embodiment, members identical to those of the above described first embodiment are denoted by the same reference symbols, and will not be described.

In the above described first embodiment, as shown in FIGS. 8A and 8B, the claw portions 150 of the first engaging claws 148 of the cover 120 are formed outward in the left-right direction and are engaged with the mounting portions 108.

In contrast to this, in the second embodiment, the cover 120 has first engaging claws 170.

The first engaging claws 170 are formed to protrude downward from the rear end portions of the horizontal portions of the bulging portions 142. That is, a pair of first engaging claws 170 is provided in the left-right direction with a gap, and the first engaging claws 148 are disposed to overlap the fixed portions 94 of the blade holding portions 91, respectively.

For shipment and transportation, the cover 120 is mounted on the developing cartridge 19. At this time, the first engaging claws 170 are engaged with the fixed portions 94 such that the rear surfaces of the first engaging claws 170 face the rear surfaces of the fixed portions 94, whereby the cover 120 is mounted on the developing cartridge 19. That is, the fixed portions 94 of the blade holding portions 91 are configured as examples of the engaged portions to be engaged with the first engaging claws 170.

Figure 10A:
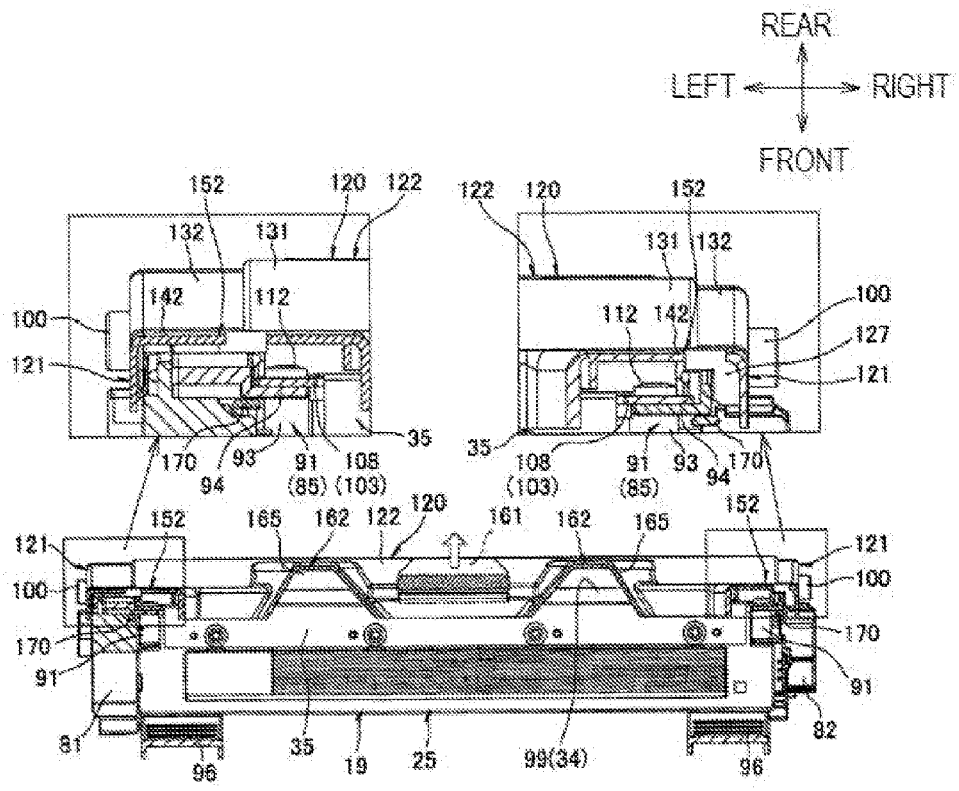
FIGS. 10A and 10B are explanatory views illustrating a section along a line D-D shown in FIG. 9B for explaining removal of the cover from the developing cartridge. More specifically.

Further, in order to remove the cover 120 from the developing cartridge 19, as shown in FIG. 10A, the cover grasping portion 161 is grasped, and the cover 120 is pulled toward the rear side. Then, the cover 120 is swung on the second engaging claws 157 counterclockwise as seen in a left side view. Since the first engaging claws 148 are provided on the upper side of the cover 120 similarly to the cover grasping portion 161, if the cover 120 is pulled toward the rear side, the first engaging claws 148 are swung toward the rear side.

Figure 10B:
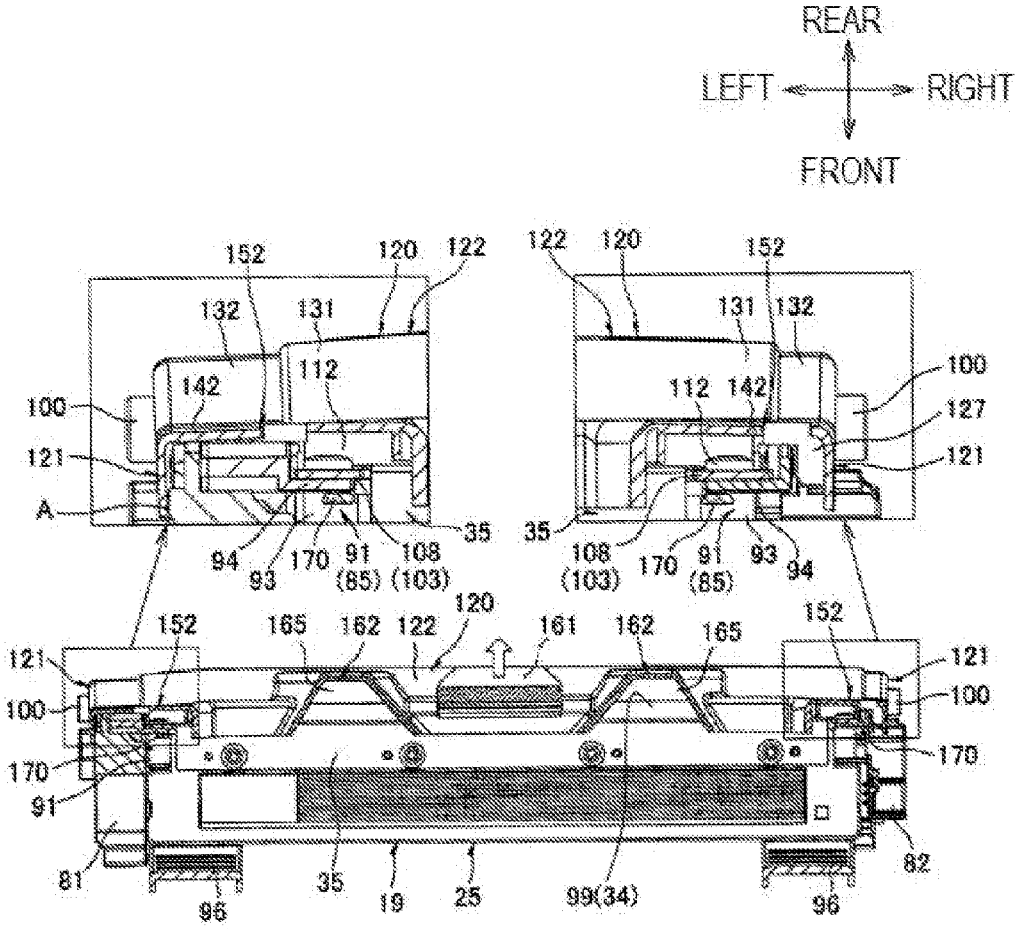

Then, since the rigidity of the first engaging claw formation areas 152 of the cover 120 is lower than that of the other portion of the cover 120, as shown in FIG. 10B, the first engaging claws 170 comes into contact with the fixed portions 94 from the front side, whereby the first engaging claw formation areas 152 are elastically deformed such that the central portion of the cover 120 in the left-right direction extends toward the rear side.

Therefore, both outer portions of the cover 120 in the left-right direction incline toward the front side along a direction toward the outer side in the left-right direction.

If the cover 120 is further pulled toward the rear side, on the left surface of the cover 120, the cover side walls 121 and the developing side walls 85 of the developing frame 25 come into contact with each other, and on the right side of the cover 120, the rib 127 and the developing side walls 85 of the developing frame 25 come into contact with each other. The contact portions of the developing side walls 85 with the cover 120 are referred to as contact portions A.

Figure 11A:
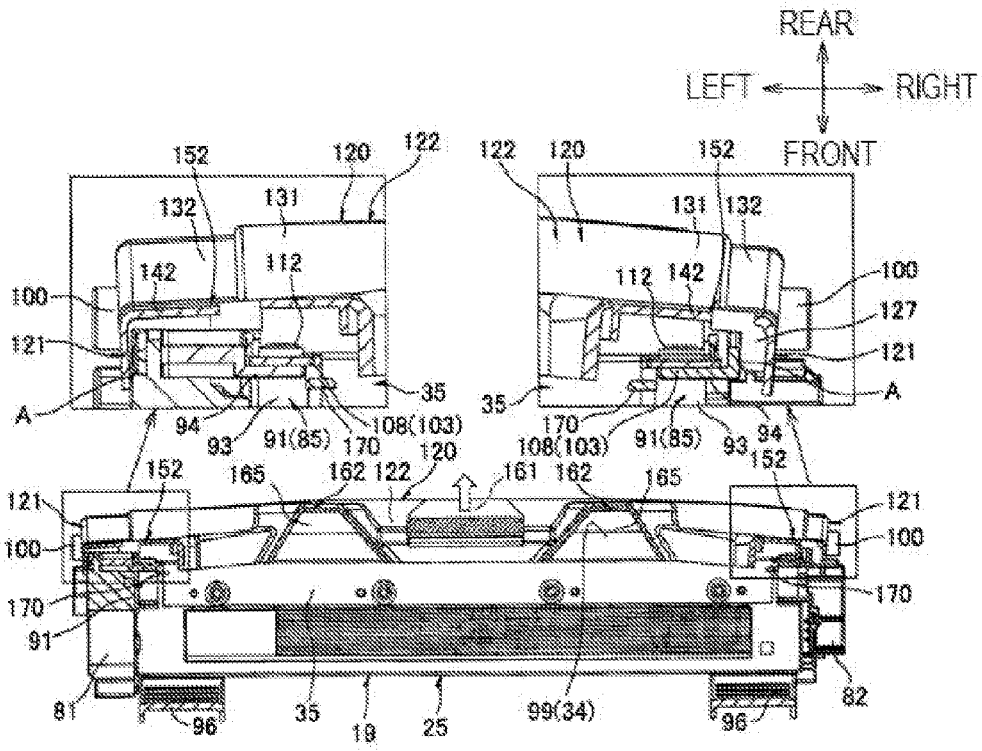
FIGS. 11A and 11B are explanatory views for further explaining removal of the cover from the developing cartridge. More specifically.

Subsequently, if the cover 120 is further pulled toward the rear side, as shown in FIG. 11A, as both outer portions of the cover 120 in the left-right direction are elastically deformed, the first engaging claws 170 are swung on the contact portions A so as to move inward in the left-right direction.

Therefore, the contact of the first engaging claws 170 with respect to the fixed portions 94 is released, and the engagement of the first engaging claws 170 with respect to the developing frame 25 is released.

Figure 11B:
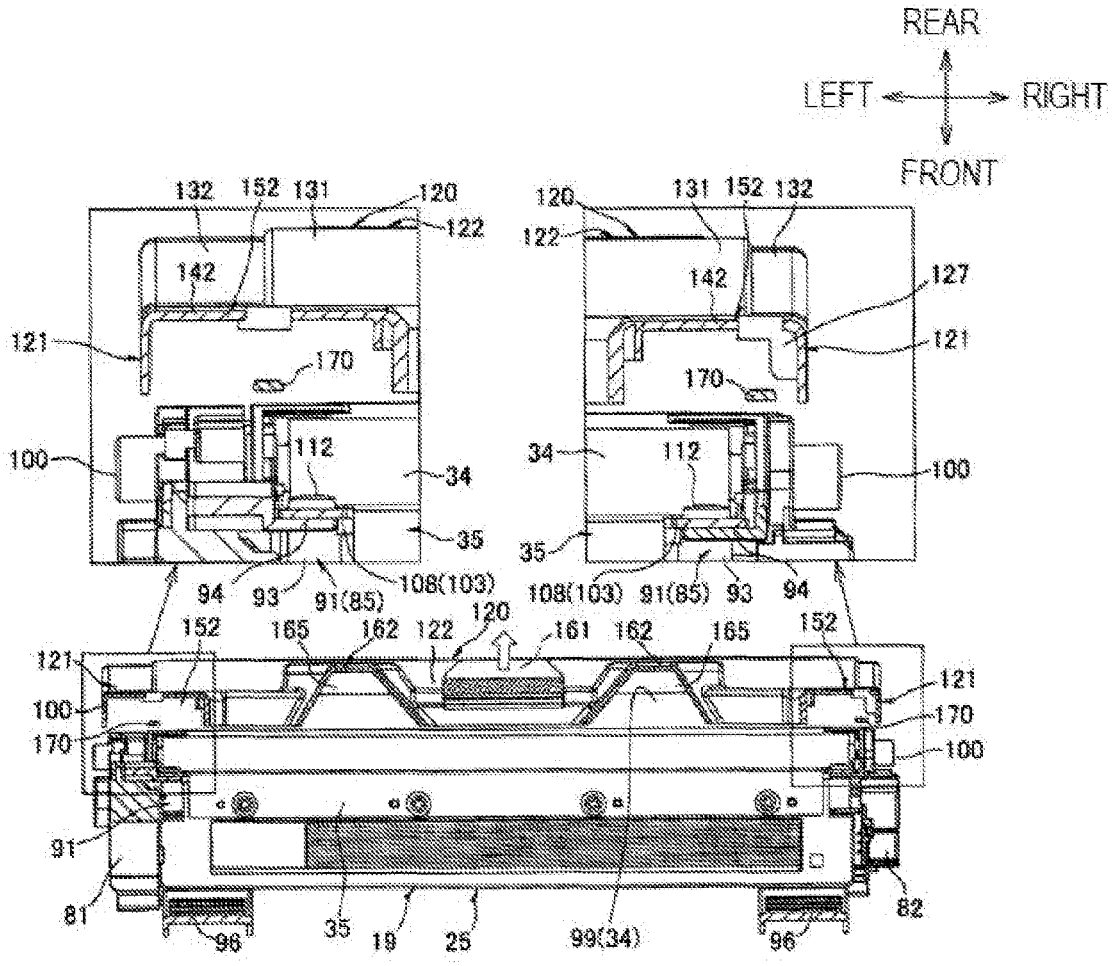

As the cover 120 is further pulled toward the rear side, engagement of the second engaging claws 157 with respect to the locking wall 95 is released. Therefore, as shown in FIG. 11B, the cover side walls 121 and the developing side walls 85 are separated from each other, and the cover 120 is restored.

In this way, removal of the cover 120 from the developing cartridge 19 is completed.

According to the second embodiment, as shown in FIGS. 10A and 10B, it is possible to engage the first engaging claws 170 with the fixed portions 94 of the blade holding portions 91. That is, it is possible to configure the fixed portions 94 as the engaged portions.

Therefore, as compared to a case where the layer-thickness regulating blade 35 is configured such that a member for assembling with the developing frame 25 and a member to be engaged with the first engaging claws 148 are separate, it is possible to reduce the number of components of the developing cartridge 19.

Even in the second embodiment, it is possible to obtain the same effects as those of the above described first embodiment.

9. Other Embodiments

In the above described first embodiment, the first engaging claws 148 of the cover 120 are engaged with the mounting portions 108, that is, the layer-thickness regulating blade 35; however, they can be engaged with the developing frame 25.

In the above described second embodiment, the first engaging claws 170 of the cover 120 are engaged with the fixed portions 94, that is, the developing frame 25; however, they can be engaged with the layer-thickness regulating blade 35.

The above described developing cartridge 19 is one example of the cartridge, and the present invention is not limited to the above described embodiments.

The developing cartridge 19 of one embodiment is attached to the printer 1 which is an example of the image forming apparatus; however, the image forming apparatus can be configured not only as the above described monochrome printer but also as a color printer.

In a case of configuring the image forming apparatus as a color printer, it is possible to configure it as a tandem type color printer using a direct system and including a plurality of photosensitive elements and recording-medium conveying members, or as a tandem type color printer using an intermediate transfer system and including a plurality of photosensitive elements, an intermediate transfer element, and a transfer member.

The cartridge of the present invention can also be configured as the above described process cartridge 15.

Further, the process cartridge 15 can be configured in a separable form such that the above described drum cartridge 18 and the developing cartridge 19 are separable from each other, or in an integrated form such that the drum cartridge 18 and the developing cartridge 19 are integrally provided.

Furthermore, it is possible to provide the photosensitive drum 20 in the main body casing 2, and attach or remove only the developing cartridge 19 with respect to the main body casing 2.

Instead of the above described feeding roller 33, any other feeding member such as a feeding sleeve, a feeding belt, or a blush-like roller can be applied.

Instead of the above described agitator 29, a conveying member such as an auger screw or a conveyor belt can be applied.

Instead of the above described transfer roller 21, a contact type transfer member such as a transfer belt, a transfer brush, a transfer blade, or a film type transfer unit, or a contactless type transfer member such as a corotron type member can be used.

Instead of the above described scorotron charger 22, a contactless type charger such as a corotron type charger, or a saw-toothed charging member, or a contact type charger such as a charging roller can be applied.

Instead of the above described scanner unit 16, an exposing member such as an LED unit can be applied.

Further, the image forming apparatus of the present disclosure may be configured to have an image reading unit or the like, thereby serving as a multi-function apparatus.

The cover of the present disclosure is provided as the cover 120 for protecting the developing roller 34 exposed from the developing frame 25 such that the cover can be attached and removed with respect to the developing frame 25; however, it can be provided as a top cover for protecting the developing frame 25 which is an example of a rotating body.

According to the above configuration, when the flexible cover is mounted on the housing, the first engaging claws are in engagement with the engaged portions. Meanwhile, if the grasping portion is operated to remove the cover from the housing, the flexible cover is bent, whereby the first engaging claws moves to the center side. As a result, the engagement with the housing is released.

In other words, if the grasping portion is not operated, the first engaging claws are in firm engagement with the engaged portions.

Meanwhile, only by operating the grasping portion, the first engaging claws move to the center side in the first direction according to the motion of the grasping portion, that is, the first engaging claws are separated from the engaged portions. Therefore, it is possible to easily release the engagement between the cover and the housing.

As a result, when the cover is mounted on the housing, since the first engaging claws are in firm engagement with the engaged portions, it is possible to securely protect the rotating body by the cover. Further, if the grasping portion is operated to remove the cover, engagement of the first engaging claws with the engaged portions is released. Therefore, it is possible to easily remove the cover from the housing.

According to this configuration, the first engaging claws are formed to be directed from the inner side toward the outer side in the first direction, and is open toward the outer side in the first direction.

Therefore, if the grasping portion is operated along the second direction, the first engaging claws smoothly move toward the center side in the first direction.

As a result, it is possible to easily separate the first engaging claws from the engaged portions, and it is possible to easily remove the cover from the housing.

According to this configuration, the cover has the grasping portion and the first engaging claws provided on one side in the third direction, and the second engaging claws provided on the other side in the third direction. Therefore, when the grasping portion is operated to separate the first engaging claws from the engaged portions, it is possible to rotate the cover on the second engaging claws along the circumferential direction of the rotating body, thereby removing the cover from the housing.

Therefore, when the cover is removed from the housing, it is possible to suppress the cover from bending toward the rotating body, and it is possible to suppress a portion of the cover from coming into contact with the rotating body.

As a result, it is possible to remove the cover from the housing while securely protecting the rotating body.

According to this configuration, in the cover, the rigidity of the first engaging claw formation portions is lower than that the other portion. Therefore, when the grasping portion is operated to remove the cover, it is possible to bend the first engaging claw formation portions more than the other portion of the cover.

Therefore, if the grasping portion is operated, it is possible to positively move the first engaging claws toward the center. Thus, it is possible to release engagement of the first engaging claws with the engaged portions with a small force.

As a result, it is possible to easily remove the cover from the housing.

According to this configuration, the rigidity of the second engaging claw formation portions is higher than the rigidity of the first engaging claw formation portions. Therefore, even if the grasping portion is operated to positively move the first engaging claws toward the center, it is possible to maintain the engagement of the second engaging claws with the housing.

Therefore, it is possible to surely remove the cover with the second engaging claws serving as a fulcrum.

According to this configuration, even if the cartridge having the engaged portions for allowing the first engaging claws to be engaged with respect to the housing is attached to an image forming apparatus, the engaged portions do not block a laser beam from an exposing means.

Therefore, during shipment and transportation of the cartridge, it is possible to engage the first engaging claws with the engaged portions, thereby surely mounting the cover on the housing, and during use, it is possible to remove the cover from the housing and attach the cartridge in an image forming apparatus such that the cartridge does not block a laser beam.

According to this configuration, it is possible to use the engaged portions as any one the layer-thickness regulating member and the positioning unit.

Therefore, as compared to a case where the engaged portions and any one of the layer-thickness regulating member and the positioning unit, it is possible to reduce the number of components of the cartridge.

According to this configuration, if the cover is bent, the contact portions come into contact with both end portions of the housing in the first direction.

Therefore, it is possible to easily separate the first engaging claws from the engaged portions with the contact portions serving as a fulcrum.

According to the cartridge of the present disclosure, it is possible to securely protect the rotating body by the cover while attaining miniaturization and it is possible to easily remove the cover from the housing.

What is claimed is:

1. A cartridge comprising:

a rotating body including a rotating shaft extending in a first direction and configured to carry developer;

a housing configured to support the rotating body; and a cover that is configured to be removably mounted on the housing and protect the rotating body; and a layer-thickness regulating blade including a blade member and a supporting member supporting the blade member, the supporting member including first and second mounting portions protruding from opposite ends of the supporting member in a direction away from the rotating body, wherein the cover includes:

a grasping portion that is provided substantially at a center of the cover in the first direction; and a first engaging claw that is disposed on a first outer side of the cover with respect to the grasping portion in the first direction, and is configured to engage the cover with the housing, the first engaging claw including a first leg portion extending from the cover in a second direction perpendicular to the first direction, and a first claw portion extending from a leading end of the first leg portion in a direction from the center to the first outer side in the first direction; and a second engaging claw that is disposed on a second outer side of the cover with respect to the grasping portion in the first direction, the second outer side being opposed to the first outer side with respect to the grasping portion, and is configured to engage the cover with the housing, the second engaging claw including a second leg portion extending from the cover in the second direction, and a second claw portion extending from a leading end of the second leg portion in a direction from the center to the second outer side in the first direction, wherein the first mounting portion includes a first engaged portion configured to be engaged with the first engaging claw, wherein the second mounting portion includes a second engaged portion configured to be engaged with the second engaging claw, and wherein when the grasping portion is operated to remove the cover from the housing, the first engaging claw and the second engaging claw move toward the center of the cover in the first direction and engagement of the first engaging claw and the first engaged portion and engagement of the second engaging claw and the second engaged portion are released.

2. The cartridge according to claim 1, wherein the cover faces the rotating body in the second direction, the grasping portion and the first and second engaging claws are provided on one side of the cover in a third direction perpendicular to both of the first direction and the second direction, and the cover includes a third engaging claw and a fourth engaging claw which are provided on the other side of the cover in the third direction for engaging the cover with the housing.

3. The cartridge according to claim 1, wherein:

the cover includes a first engaging claw formation portion where the first engaging claw and the second engaging claw are formed, and rigidity of the first engaging claw formation portion of the cover is lower than that of the other portion of the cover.

4. The cartridge according to claim 2, wherein:

the cover includes:

a first engaging claw formation portion where the first engaging claw and the second engaging claw are formed, and a second engaging claw formation portion where the third engaging claw and the fourth engaging claw are formed, rigidity of the first engaging claw formation portion is lower than that of the other portion of the cover, and the rigidity of the second engaging claw formation portion is higher than the first engaging claw formation portion.

5. The cartridge according to claim 1, wherein when the cartridge is attached to an image forming apparatus, the first engaged portion and the second engaged portion are disposed so as not to block a laser beam emitted from an exposing member of the image forming apparatus.

6. The cartridge according to claim 1, wherein the cover has a pair of side walls at both end portions in the first direction, the housing includes contact potions that comes into contact with the side walls when the cover is removed from the housing, and the contact portions increase the movement amount of the first engaging claw and the second engaging claw toward the center side along the first direction with the contact portions serving as a fulcrum.

* * * * *